US010349729B1

(12) United States Patent
Cheema et al.

(10) Patent No.: US 10,349,729 B1
(45) Date of Patent: Jul. 16, 2019

(54) MULTI-TIP BRUSH TOOL

(71) Applicants: Ayesha Adam Cheema, Kennesaw, GA (US); Qasim Cheema, Kennesaw, GA (US)

(72) Inventors: Ayesha Adam Cheema, Kennesaw, GA (US); Qasim Cheema, Kennesaw, GA (US)

( * ) Notice: Subject to any disclaimer, the term of this patent is extended or adjusted under 35 U.S.C. 154(b) by 0 days.

(21) Appl. No.: 15/969,549

(22) Filed: May 2, 2018

(51) Int. Cl.
*A46B 5/00* (2006.01)

(52) U.S. Cl.
CPC .... *A46B 5/0008* (2013.01); *A46B 2200/1046* (2013.01)

(58) Field of Classification Search
CPC .... A45C 5/005; A45D 40/261; A45D 40/262; A45D 40/264; A45D 44/18; A46B 9/08; A46B 9/10; A46B 9/021; A46B 7/08; A46B 7/044; A46B 7/026; A46B 7/023; A46B 7/02; A46B 5/0079; A46B 5/0016; A46B 5/0008; A46B 5/0004; A46B 2200/1046; A46B 13/02; A46B 13/008
USPC ..... 132/290, 294, 311, 313; 206/361–362; 15/106, 184
See application file for complete search history.

(56) References Cited

U.S. PATENT DOCUMENTS 2,236,240 A * 3/1941 Lowen ..... A45D 40/18 15/172
2,552,714 A * 5/1951 Gardiner ..... A45D 40/18 132/318
3,132,653 A * 5/1964 Gazdik ..... A45D 34/045 15/105
3,320,962 A * 5/1967 Moriber ..... A45D 40/20 401/31
D276,192 S * 11/1984 Fusco ..... D4/120
5,109,877 A * 5/1992 Takeda ..... A46B 7/023 132/218
5,301,808 A * 4/1994 Pierson ..... A45D 40/24 132/297
6,439,885 B2 * 8/2002 Antler ..... A61C 3/00 433/142

(Continued)

FOREIGN PATENT DOCUMENTS

KR 10-2009-0025175 * 3/2009

*Primary Examiner* — Tatiana L Nobrega
*Assistant Examiner* — Jennifer F Gill

(57) ABSTRACT

The multi-tip brush tool is an apparatus that contains and organizes makeup brushes. The apparatus includes a manual cosmetic body, a plurality of retractable brushes, a removable casing, and a plurality of spring-loaded mechanisms. The manual cosmetic body houses the plurality of retractable brushes and the removable casing. The plurality of spring-loaded mechanisms extends and retracts the plurality of retractable brushes and the removable casing within the manual cosmetic body. The plurality of retractable brushes are makeup brushes that are preferably interchangeable. The removable casing contains stand-alone makeup brushes that freely move within the removable casing. The removable casing is entirely separable from the manual cosmetic body. The apparatus further includes a rotating cosmetic body, a primary adapter and a removable brush. The rotating cosmetic body automatically and continuously rotates the removable brush and is connected to the manual cosmetic body by the primary adapter.

13 Claims, 11 Drawing Sheets

(56) References Cited

U.S. PATENT DOCUMENTS

| | | | | |
|---|---|---|---|---|
| 2012/0260931 | A1* | 10/2012 | Martin | A46B 13/02<br>132/200 |
| 2015/0034113 | A1* | 2/2015 | Yamagishi | A46B 13/02<br>132/200 |
| 2015/0257522 | A1* | 9/2015 | Boyke | A46B 11/001<br>132/311 |

* cited by examiner

MULTI-TIP BRUSH TOOL

FIELD OF THE INVENTION

The present invention generally relates to makeup brushes. More specifically, the present invention stores and organizes a plurality of brushes in order to facilitate makeup application on-the-go.

BACKGROUND OF THE INVENTION

Cosmetics enhance the aesthetic appearance of the human body. The earliest known evidence of cosmetics dates to Ancient Egyptian pharaohs that used castor oil as balm. In modern times, the cosmetic industry has grown immensely and continues to grow because of the film and fashion industry. In addition to the celebrities in the film and fashion industry, cosmetic products are used daily by the public. Whether cosmetics are for commercial or personal use, the one item that is quintessential to the process is the brush. A make-up brush allows an individual to employ different cosmetic products to the human body, typically the face. To accommodate the various needs of the cosmetic industry, an extensive amount of make-up brushes has been invented. Each brush possesses their own distinct purpose, defined by it shapes and sizes.

For most of the popular cosmetic applications, there are ten essential types of brushes. The ten types of brushes are foundation, powder, blush, concealer, contour, highlight, blending, shadow, crease, lip and liner. Each of these brushes comprises different material in an arrangement, resulting in unique and specific purposes. For example, foundation brushes have long, flat and tapered tips, ideal for applying foundation to the face in a uniform fashion. Liner brushes, on the other hand, comprise small and short bristles, ideal for detailed and precise application of eye liner. Powder brushes are defined by fluffy, soft, full rounded bristles, perfect for light application of cosmetic powder in order to set a foundation. Each of these brushes is designed for the application of one or two make-up products, using a liner brush for the application of foundation would not work.

It is ideal to own the vast majority of these brushes for anyone working with or using make-up, either on a film set or just at home. It is therefore an objective of the present invention to maximize the amount of brushes and minimize the amount of space required to store the brushes. Furthermore, the present invention organizes the brushes, facilitating the use and storage of each brush. Moreover, the present invention combines a plurality of brushes into a single device, allowing the user quicker and more efficient access to said brushes.

DETAIL DESCRIPTIONS OF THE INVENTION

All illustrations of the drawings are for the purpose of describing selected versions of the present invention and are not intended to limit the scope of the present invention.

Figure 10:
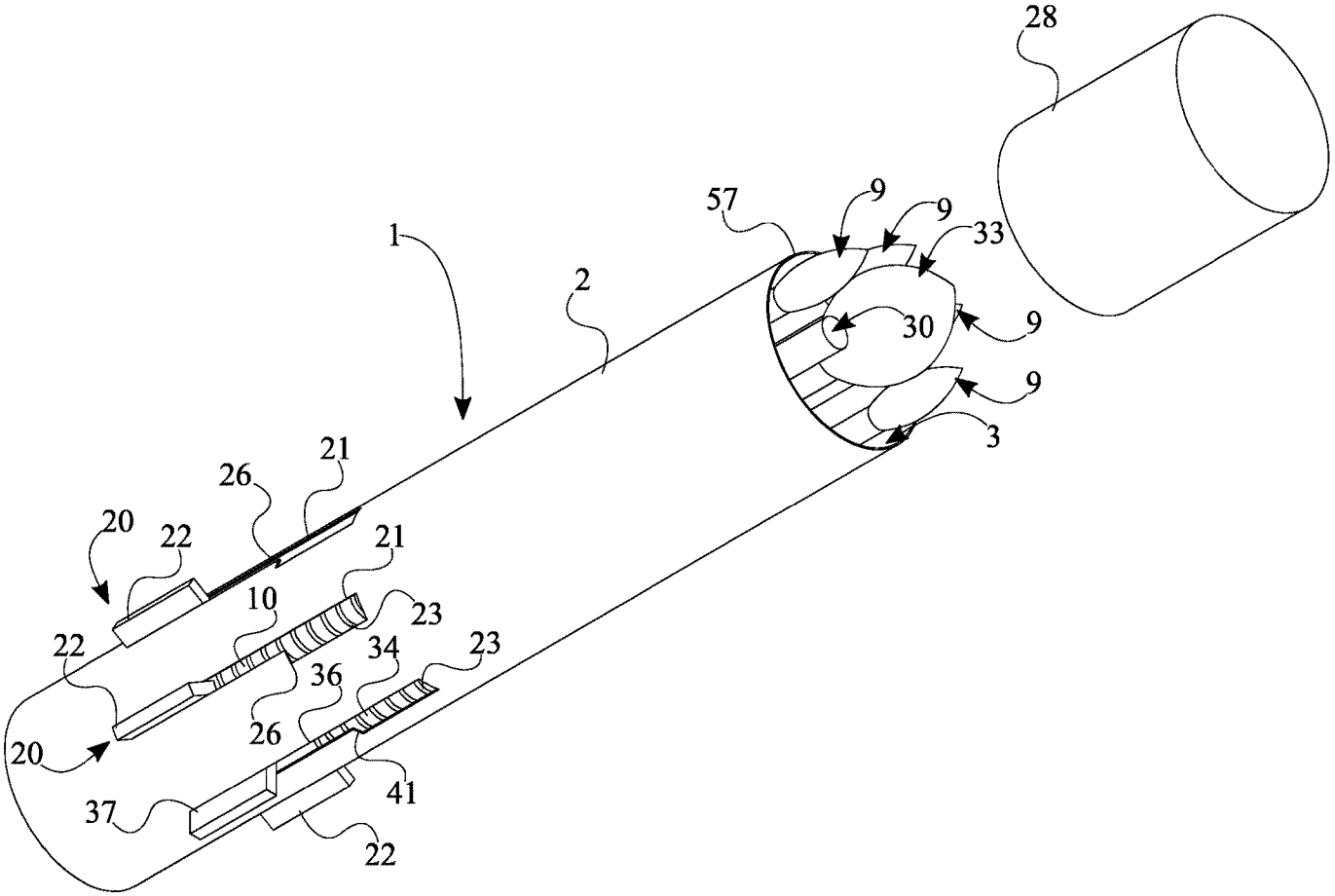
FIG. 10 is a bottom exploded view of the preferred embodiment of the present invention.

The present invention is a multi-tip makeup brush tool that organizes and stores a plurality of makeup brushes into a single portable unit. The present invention facilitates the interchangeability of the brushes in order to tend to the makeup application of the user. In order for present invention to maximize the amount of makeup brushes within a single portable unit while allowing the user to stably apply makeup with each makeup brush, the present invention comprises a manual cosmetic body 1, a plurality of retractable brushes 9, a removable casing 15, and a plurality of spring-loaded mechanisms 20, seen in FIG. 6 and FIG. 10. The manual cosmetic body 1 mounts and contains the plurality of retractable brushes 9 and the removable casing 15. The manual cosmetic body 1 comprises a barrel 2, a divider plate 4, a plurality of brush slots 6, and a casing slot 7. The barrel 2 surrounds the plurality of retractable brushes 9, the removable casing 15, and the divider plate 4. The divider plate 4 positions the plurality of retractable brushes 9 within the barrel 2. The plurality of brush slots 6 allows the plurality of retractable brushes 9 to slide into and out of the barrel 2 and through the divider plate 4. Similarly, the casing slot 7 allows the removable casing 15 to slide into and out of the barrel 2 and through the divider plate 4. The plurality of retractable brushes 9 retains makeup and delivers the makeup to the skin of the user upon the application of each retractable brush 9 against the skin of the user. More specifically, makeup is held by the plurality of retractable brushes 9 after the user presses the plurality of retractable brushes 9 against makeup such as foundation or blush. The removable casing 15 houses a variety of stand-alone brushes that are free within the removable casing 15. The plurality of spring-loaded mechanisms 20 extends and retracts the plurality of retractable brushes 9 and the removable casing 15 while connecting the plurality of retractable brushes 9 and removable casing 15 to the manual cosmetic body 1.

Figure 8:
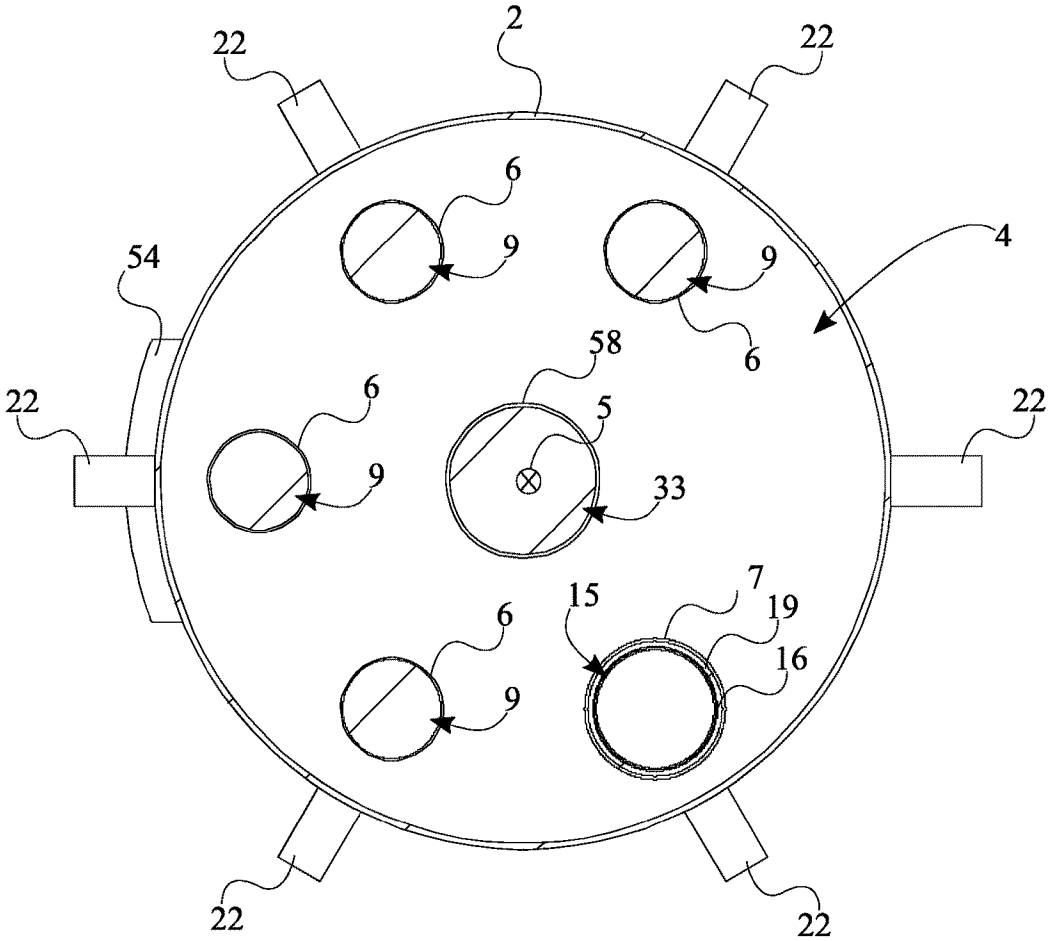
FIG. 8 is a cross-section view of FIG. 7 along line 8-8 of the present invention.
Figure 9:
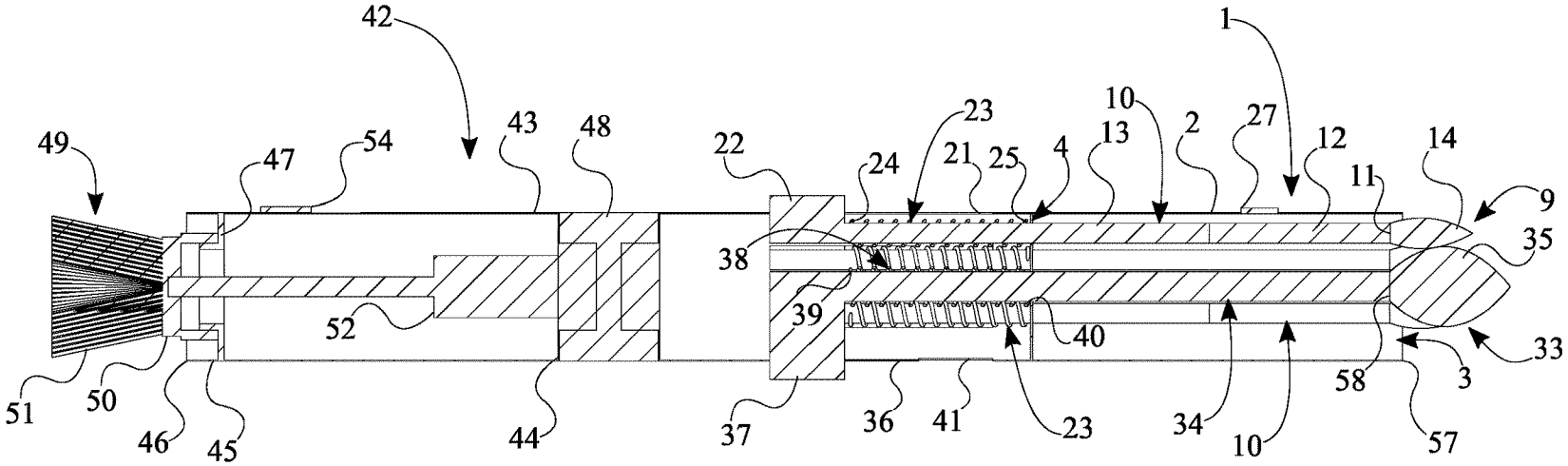
FIG. 9 is a cross-section view of FIG. 7 along line 9-9 of the present invention.

The overall configuration of the aforementioned components allows a user to select and use a single makeup brush individually while preserving the containment and organization of the remaining plurality of retractable brushes 9 and the removable casing 15 within the manual cosmetic body 1. In order to effectively organize the plurality of retractable brushes 9 and the removable casing 15 within the manual cosmetic body 1, the divider plate 4 is mounted within the barrel 2, and the plurality of brush slots 6 and the casing slot 7 radially traverse through the divider plate 4, as shown in FIG. 8 and FIG. 9. In order for each of the plurality of retractable brushes 9 and the removable casing 15 to be engaged individually through the manual cosmetic body 1, the plurality of brush slots 6 and the casing slot 7 are oriented parallel to an opening 3 of the barrel 2. Moreover, the opening 3 of the barrel 2 is delineated by a rim 57 of the barrel 2. The plurality of retractable brushes 9 is slidably engaged with the plurality of brush slots 6, thereby allowing the plurality of retractable brush slots to extend and retract through the opening 3 of the barrel 2. Similarly, the removable casing 15 is slidably engaged with the casing slot 7 in order for the removable casing 15 to extend and retract through the opening 3 of the barrel 2. More specifically, the plurality of retractable brushes 9 and the removable casing 15 is operatively coupled with the barrel 2 through the plurality of spring-loaded mechanisms 20, wherein the plurality of spring-loaded mechanisms 20 selectively extends and retracts the plurality of retractable brushes 9 and the removable casing 15 through the opening 3. This arrangement allows each of the plurality of retractable brushes 9 and the removable casing 15 to automatically retract within the manual cosmetic body 1.

In order for the plurality of retractable brushes 9 to apply makeup to the skin of the user while being connected to the manual cosmetic body 1, each of the plurality of retractable brushes 9 comprises a first handle 10 and an applicator 14, as seen in FIG. 9. Each of the retractable brushes 9 are automatically retractable within the manual cosmetic body 1 as each of the plurality of spring-loaded mechanisms 20 comprises a track 21, a tab 22, and a spring 23. The first handle 10 connects the applicator 14 to the manual cosmetic body 1, and the applicator 14 captures and retains makeup. The applicator 14 may be a variety of brush ends such eyeshadow sponge, a foundation brush, an angled-contouring brush, a blush brush, and so on. The makeup is captured as the user presses the applicator 14 against the makeup and retained until the user applies the applicator 14 to the face or body. The track 21 allows each of the first handle 10 to slide into and out of the opening 3 of the barrel 2 with the tab 22. The spring 23 allows the first handle 10 to automatically retract within the barrel 2.

Each of the plurality of retractable brushes 9 are positioned within the barrel 2 as the first handle 10 traverses through a corresponding slot of the plurality of brush slots 6, also seen in FIG. 8 and FIG. 9. In order for the applicator 14 to enter and exit the barrel 2, the applicator 14 is terminally connected to a distal end 11 of the first handle 10, oriented towards the opening 3 of the barrel 2. The tab 22 is laterally fixed along the first handle 10, and the track 21 laterally traverses through and along the barrel 2, allowing each of the plurality of retractable brushes 9 to be accessed by the user and engaged individually. More specifically, the tab 22 traverses through the track 21. In order for the first handle 10 to be automatically retracted, the spring 23 is coaxially aligned with the first handle 10, positioned in between the tab 22 and the divider plate 4. A proximal end 24 of the spring 23 is fixed to the tab 22, and a distal end 25 of the spring 23 is fixed to the divider plate 4. This arrangement allows the tab 22 to be pushed along the track 21 and the tab 22 to be stopped along the track 21 by the divider plate 4.

Each of the plurality of retractable brushes 9 are interchangeable as the first handle 10 comprises a first member 12 and a second member 13, as seen in FIG. 8 and FIG. 9. The first member 12 is attached to the second member 13. In the preferred embodiment of the present invention, the first member 12 is attached to the second member 13 with a couple of magnets. However, alternate embodiments of the present invention may comprise a variety of fasteners that facilitate the interchangeability of the plurality of retractable brushes 9, while preserving the structural integrity of the plurality of retractable brushes 9 within the barrel 2. In order to maintain the organization of the plurality of retractable brushes 9 within the barrel 2 and maximize the space within the barrel 2, the first member 12 and the second member 13 are concentrically positioned with each other. More specifically, the tab 22 is laterally fixed along the second member 13, and the second member 13 traverses through the corresponding slot of the plurality of brush slots 6. Furthermore, the applicator 14 is terminally connected to the first member 12 oriented towards the opening 3 of the barrel 2.

As each of the plurality of retractable brushes 9 may be individually engaged, the present invention further comprises a release button 27 in order to retract the plurality of retractable brushes 9 simultaneously into the barrel 2, as seen in FIG. 1, FIG. 2, FIG. 3, FIG. 4, FIG. 5, FIG. 6, FIG. 7, and FIG. 9. Each of the plurality of spring-loaded mechanisms 20 comprises a track 21, a tab 22, a spring 23 and a notch 26, shown in FIG. 8, FIG. 9. And FIG. 10. The notch 26 fixes the position of the tab 22 along the track 21 where each of the plurality of retractable brushes 9 is in an extended configuration. The notch 26 laterally traverses through and along the barrel 2, positioned adjacent the first track 21, defining a continuous path for the tab 22. In order for the user to access the release button 27, the release button 27 is integrated onto the barrel 2. The release button 27 is operatively coupled with the tab 22, wherein the release button 27 locks and unlocks the tab 22 into the notch 26 with the spring 23.

Shown in FIG. 1, FIG. 3, FIG. 4, FIG. 6, and FIG. 10, the present invention further comprises a first cover 28 which protects the applicator 14 of each of the plurality of retractable brushes 9. A rim 29 of the first cover 28 is attached to the rim 57 of the barrel 2. In the preferred embodiment of the present invention, the first cover 28 snaps onto the barrel 2 and surrounds the applicator 14 of each of the plurality of brushes while in a retracted configuration.

In order for the entirety of the removable casing 15 to be disconnected from the manual cosmetic body 1, the removable casing 15 comprises a cylindrical compartment 16 and a bed 19, shown in FIG. 8. The cylindrical compartment 16 houses a plurality of makeup brushes that freely move within the cylindrical compartment 16. The bed 19 mounts the cylindrical compartment 16 within the barrel 2. Similar to the first handle 10, the cylindrical compartment 16 traverses through the casing slot 7. In order to mount the cylindrical compartment 16 within the barrel 2, while preserving access to the plurality of makeup brushes within the cylindrical compartment 16, the bed 19 is positioned adjacent the cylindrical compartment 16, opposite an opening 17 of the cylindrical compartment 16. The opening 17 of the cylindrical compartment 16 is delineated by a rim 18 of the cylindrical compartment 16. Moreover, the rim 18 of the cylindrical compartment 16 is oriented towards the opening 3 of the barrel 2. The cylindrical compartment 16 is removably mounted within the bed 19, thereby allowing the cylindrical compartment 16 to be entirely separated from within the barrel 2. The bed 19, however, is contained within the barrel 2, similar to the second member 13 of the first handle 10. As each spring-loaded mechanism 20 comprises a track 21, a tab 22, and a spring 23, the tab 22 is laterally fixed along the bed 19. The track 21 laterally traverses through and along the barrel 2, and the tab 22 traverses through the track 21, similar to the arrangement of each retractable brush of the plurality of retractable brushes 9 and each spring-loaded mechanism of the plurality of spring-loaded mechanisms 20. The spring 23 is coaxially aligned with the bed 19, positioned in between the tab 22 and the divider plate 4, allowing the bed 19, and consequently the cylindrical compartment 16, to be automatically retracted. A proximal end 24 of the spring 23 is fixed to the tab 22, and a distal end 25 of the spring 23 is fixed to the divider plate 4, allowing the tab 22 to be pushed along the track 21 and the tab 22 to be stopped along the track 21 by the divider plate 4.

Figure 1:
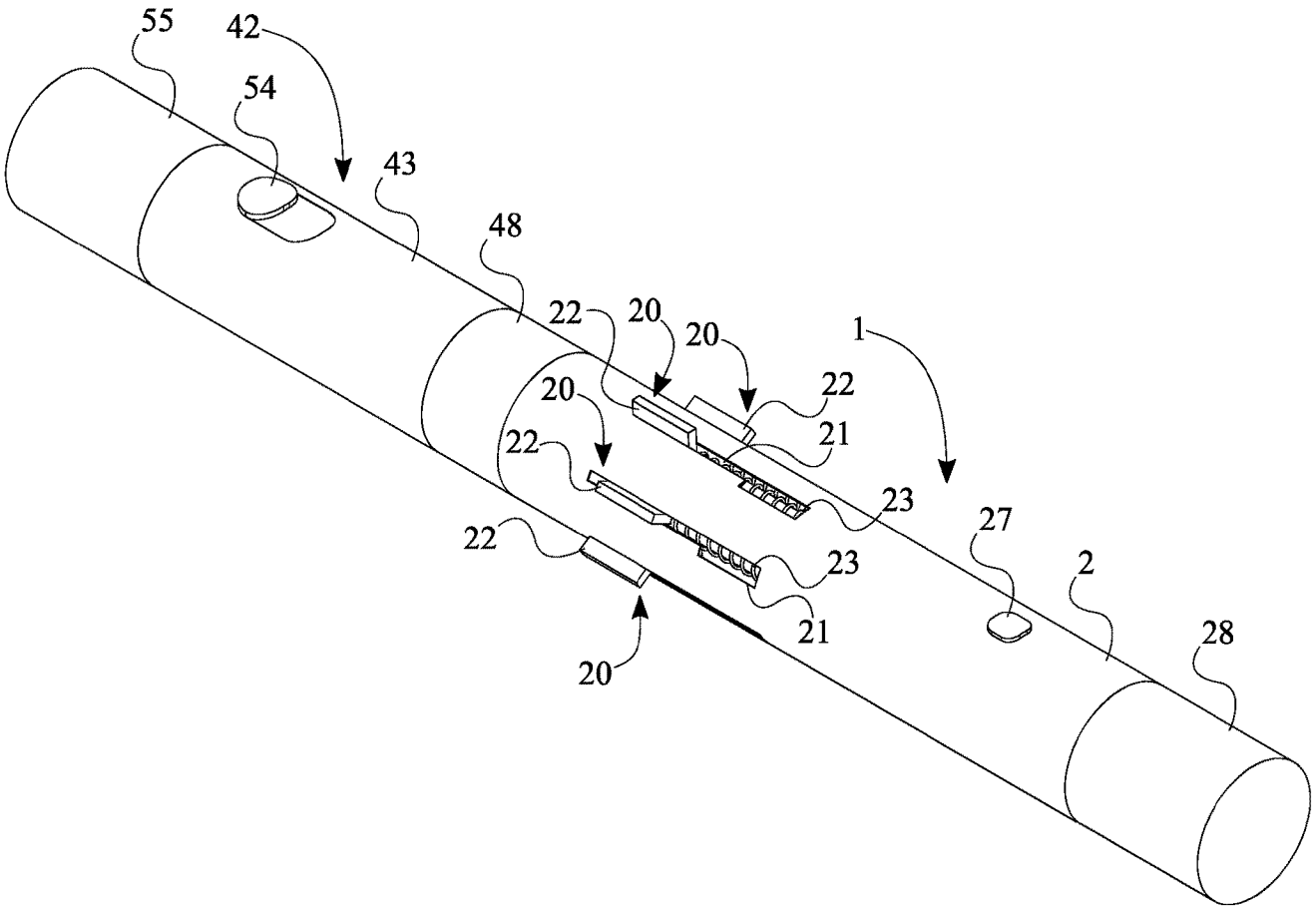
FIG. 1 is a perspective view of the first alternate embodiment of the present invention.
Figure 2:
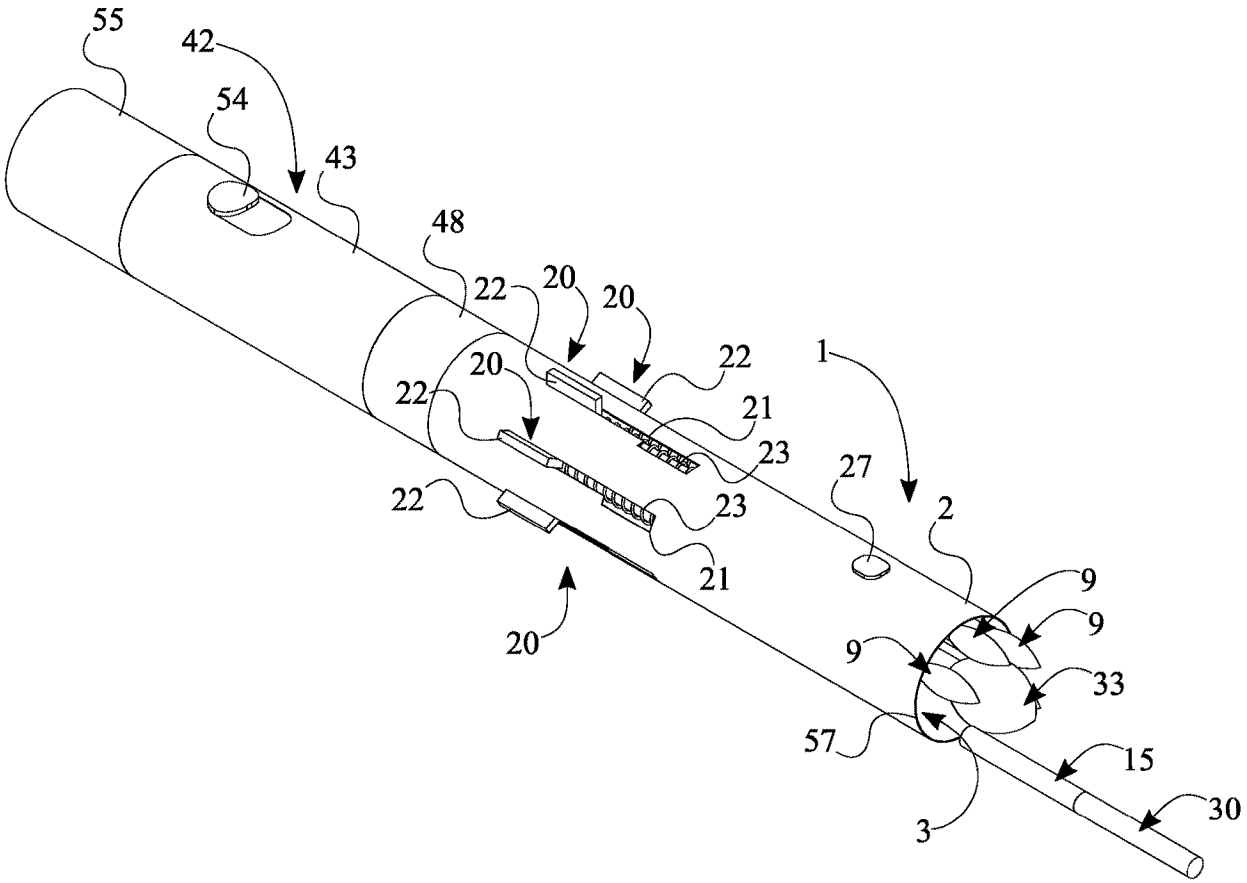
FIG. 2 is a perspective view of the first alternate embodiment of the present invention without a first cover and a removable casing and a cap separated from a manual cosmetic body.
Figure 3:
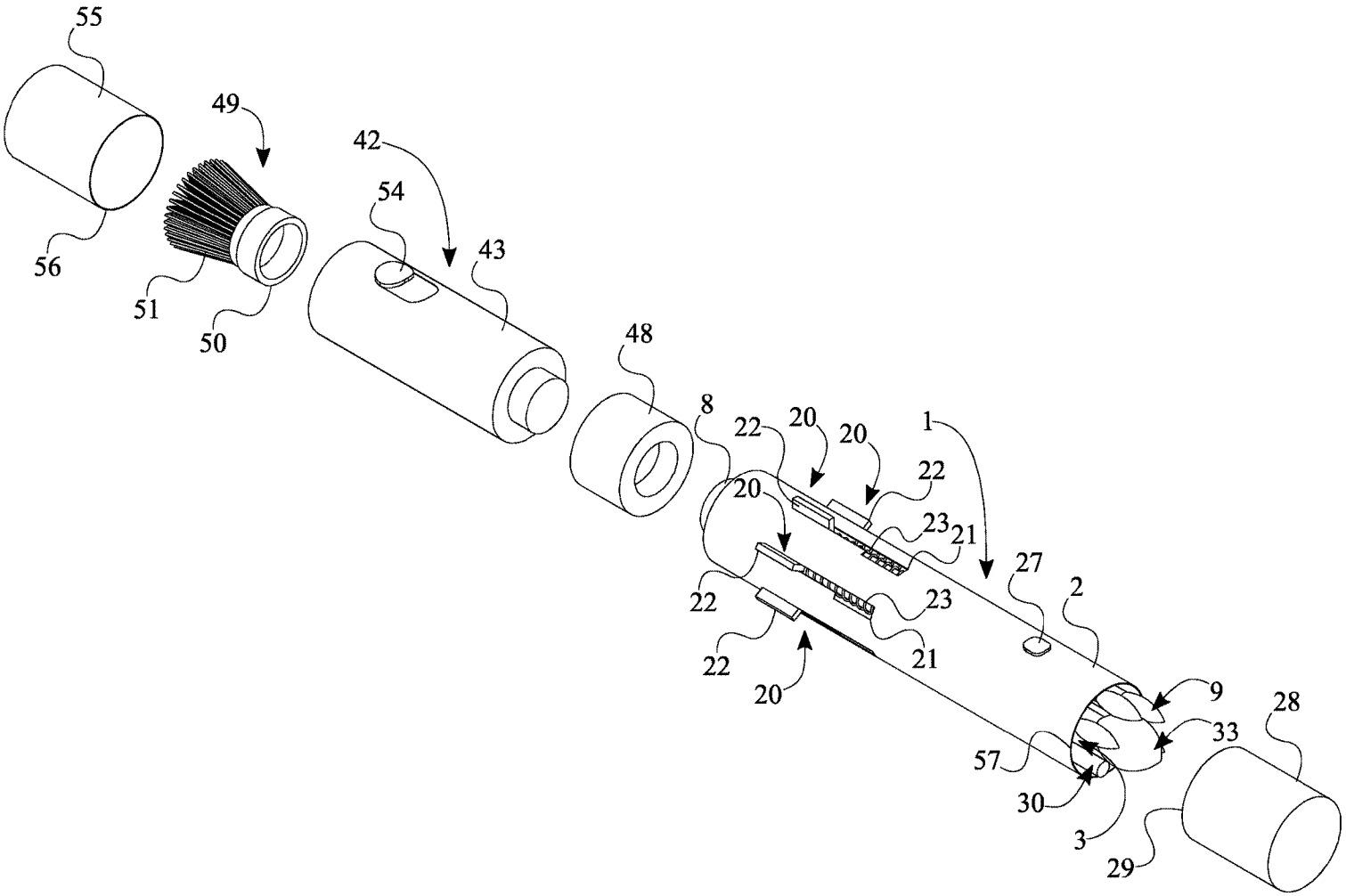
FIG. 3 is a front exploded view of the first alternate embodiment of the present invention.
Figure 4:
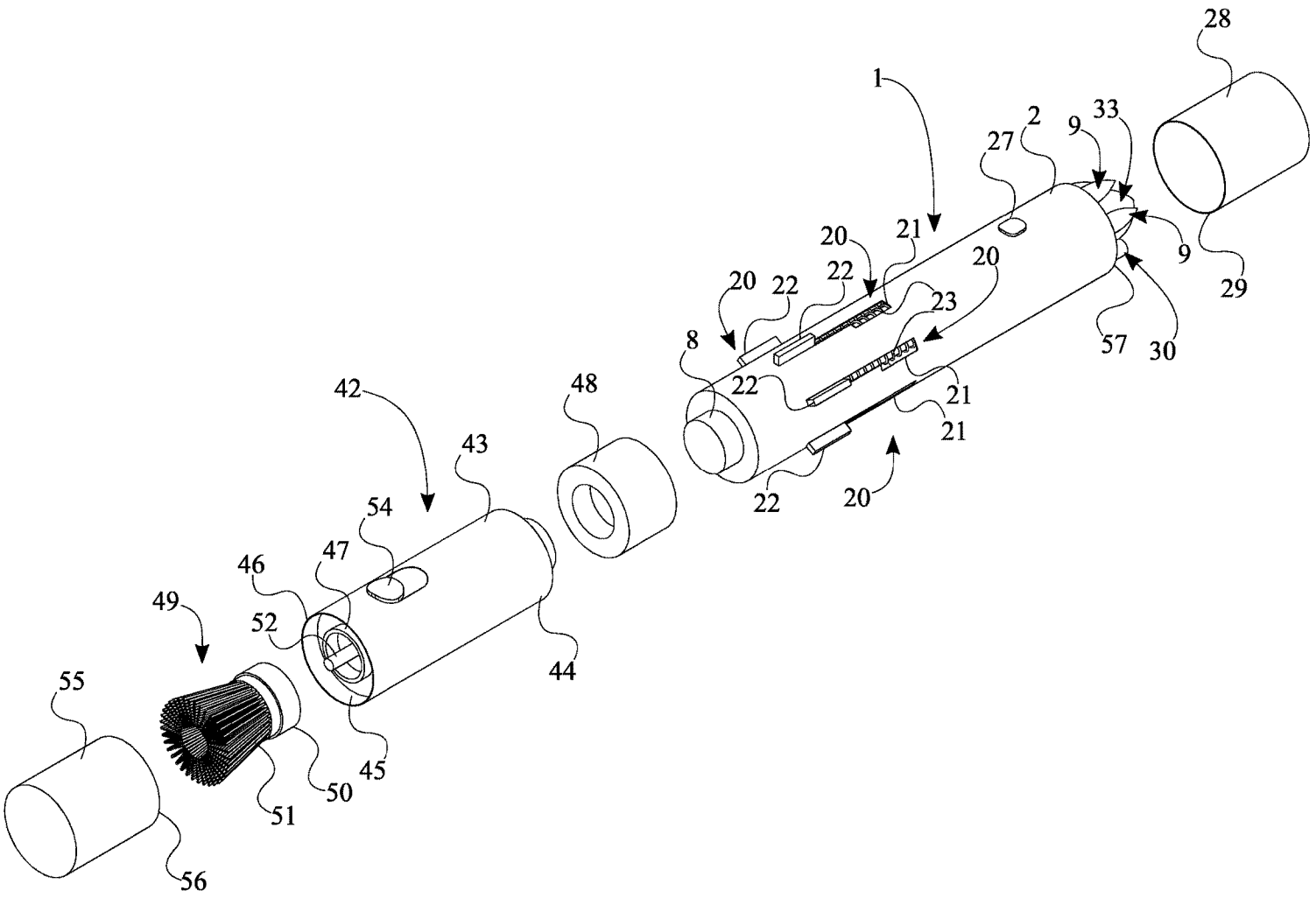
FIG. 4 is a rear exploded view of the first alternate embodiment of the present invention.
Figure 5:
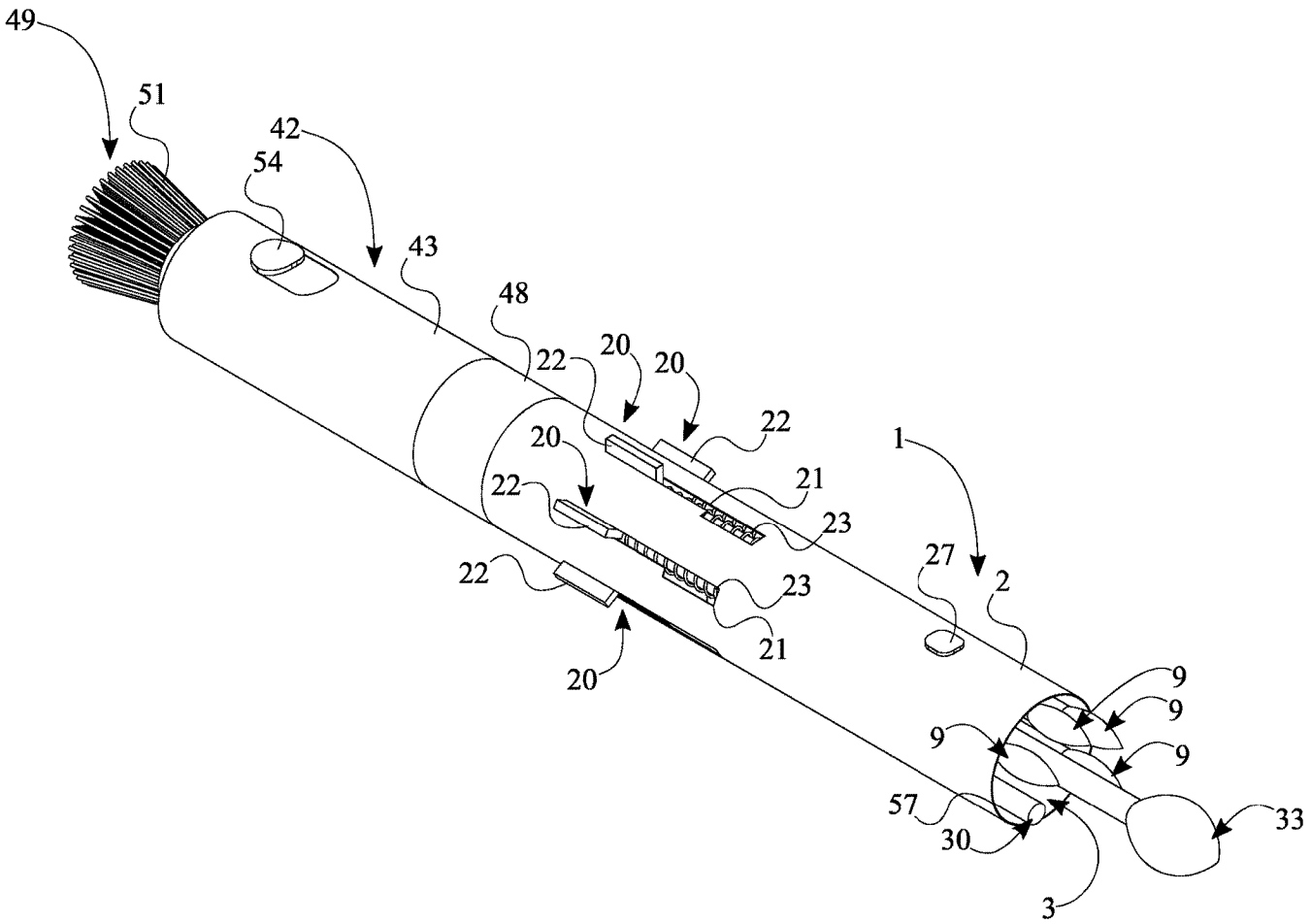
FIG. 5 is a perspective view of the first alternate embodiment of the present invention without the first cover and a second cover and the central brush in an extended configuration.
Figure 6:
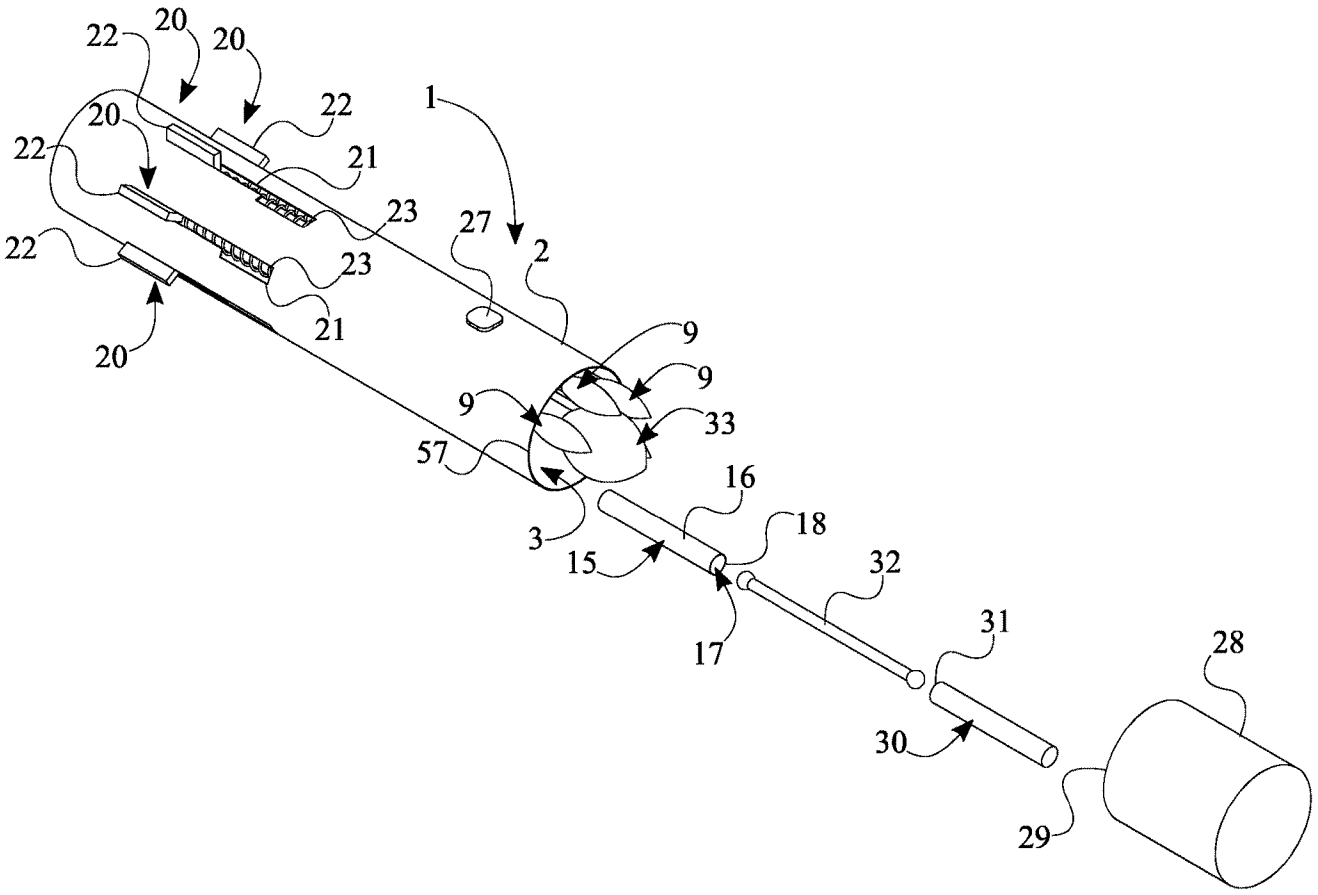
FIG. 6 is a perspective view of the preferred embodiment of the present invention with the removable casing and the cap separated from each other and the at least one dual-ended brush removed from within the removable casing and the cap.
Figure 7:
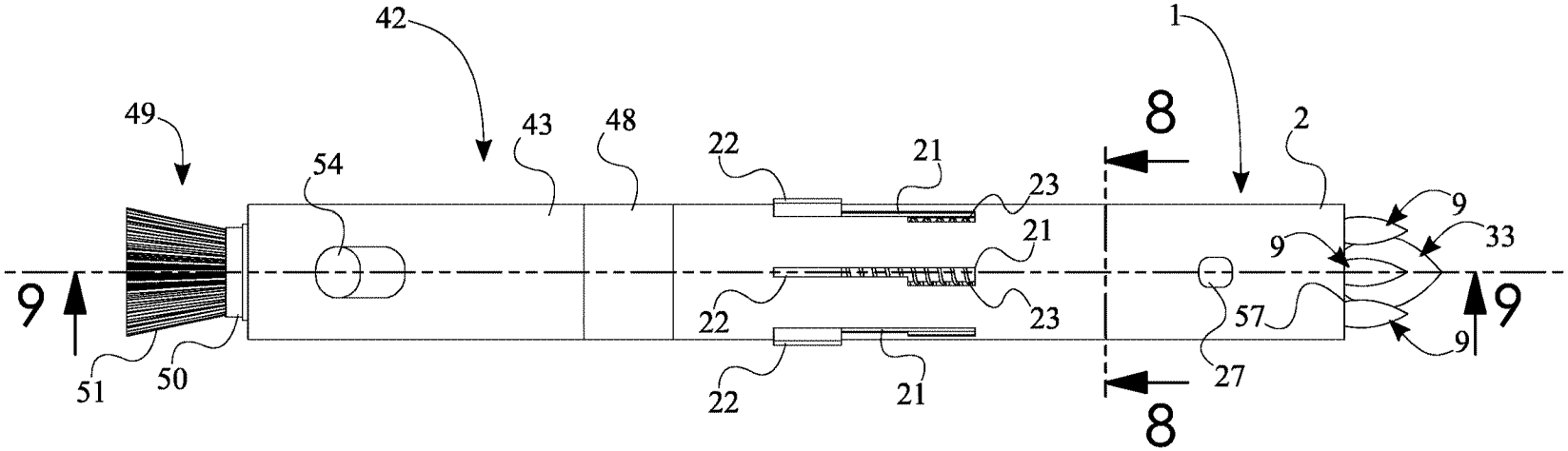
FIG. 7 is a top side view of the first alternate embodiment of the present invention.

In the preferred embodiment of the present invention, the removable casing 15 is positioned in between an arbitrary brush and an adjacent brush of the plurality of retractable brushes 9, also seen in FIG. 8. This arrangement maximizes the space within the barrel 2 and maintains the organization of the plurality of retractable brushes 9 and the removable casing 15 within the barrel 2. The preferred embodiment of the present invention also comprises a cap 30 and at least one dual-ended brush 32, as seen in FIG. 6. The cap 30 encloses the at least one dual-ended brush 32 within the cylindrical compartment 16. The at least one dual-ended brush 32 is a makeup brush that freely moves within the cylindrical compartment 16. Moreover, the at least one dual-ended brush 32 is positioned within the cylindrical compartment 16. In order to connect the cap 30 to the cylindrical compartment 16, a rim 31 of the cap 30 is removably attached to the rim 18 of the cylindrical compartment 16 over the at least one dual-ended brush 32.

As the plurality of brush slots 6 and the casing slot 7 radially traverses through the divider plate 4, the plurality of spring-loaded mechanisms 20 is radially distributed about a central axis 5 of the divider plate 4, as seen in FIG. 8. This arrangement accommodates the position of the plurality of retractable brushes 9 and the removable casing 15 and allows the plurality of retractable brushes 9 and the removable casing 15 to automatically retract within the barrel 2. Moreover, the casing slot 7 and the plurality of brush slots 6 are radially distributed about the central axis 5 of the divider plate 4. In order for the removable casing 15 to be engaged with the one of the plurality of spring-loaded mechanisms 20, the casing slot 7 is positioned adjacent to one of the plurality of spring-loaded mechanisms 20, as seen in FIG. 1, FIG. 2, FIG. 3, FIG. 4, FIG. 5, FIG. 6, FIG. 7, and FIG. 10. Similarly, each brush slot is positioned adjacent to a corresponding mechanism from the plurality of spring-loaded mechanisms 20 in order for each retractable brush to be engaged with a corresponding mechanism.

The present invention further comprises a central brush 33, seen in FIG. 2, FIG. 3, FIG. 4, FIG. 5, FIG. 6, FIG. 7, FIG. 9, and FIG. 10. The central brush 33 is preferably a larger makeup brush that further maximizes the space within the barrel 2. Similar to that of the plurality of retractable brushes 9, the central brush 33 comprises a second handle 34, a second applicator 35, a second track 36, a second tab 37, a second spring 38, and a second notch 41. In order to accommodate the central brush 33, the manual cosmetic body 1 further comprises a central slot 58. The central slot 58 traverses through the divider plate 4, along a central axis 5 of the divider plate 4 and is oriented parallel to the opening 3 of the barrel 2, allowing the extension and retraction of the second handle 34 through the opening 3 of the barrel 2. The plurality of slots is radially distributed around the central slot 58. The second handle 34 traverses through the central slot 58, effectively positioning the central brush 33 within the manual cosmetic body 1. The second applicator 35 is terminally connected to the distal end 58 of the second handle 34, oriented towards the opening 3 of the barrel 2, similar to that of the plurality of retractable brushes 9. The second tab 37 is laterally fixed along the second handle 34, and the second track 36 laterally traverses through and along the barrel 2, allowing the central brush 33 to be accessed by the user. More specifically, the second tab 37 traverses through the second track 36. In order for the second handle 34 to be automatically retracted, the second spring 38 is coaxially aligned with the second handle 34, positioned in between the second tab 37 and the divider plate 4. A proximal end 39 of the second spring 38 is fixed to the second tab 37, and a distal end 40 of the second spring 38 is fixed to the divider plate 4. This arrangement allows the second tab 37 to be pushed along the second track 36 and the second tab 37 to be stopped along the second track 36 by the divider plate 4.

In alternate embodiments of the present invention, the central brush 33 comprises a third member and a fourth member. The third member and fourth member allow the central brush 33 to be interchanged similar to that of the plurality of retractable brushes 9. The third member is attached to the fourth member, similar to that of the first member 12 and the second member 13. The third member and the fourth member are concentrically positioned with each other. The second tab 37 is laterally fixed along the fourth member, and the fourth member traverses through the central slot 58. The second applicator 38 is connected to the third member, oriented towards the opening 3 of the barrel 2.

A first alternate embodiment of the present invention further comprises a motor housing 42, a primary adapter 48, and a removable brush 49, seen in FIG. 1, FIG. 2, FIG. 3, FIG. 4, FIG. 5, FIG. 7, FIG. 9, and FIG. 10. The motor housing 42 houses and automatically rotates the removable brush 49. The motor housing 42 comprises a tubular handle 43 and a secondary adapter 47. The tubular handle 43 houses the mechanisms necessary to automatically and continuously rotate the removable brush 49. The secondary adapter 47 connects the removable brush 49 to the tubular handle 43. The primary adapter 48 connects the motor housing 42 to the manual cosmetic body 1. In order for the manual cosmetic body 1 to be connected to the primary adapter 48, the manual cosmetic body 1 further comprises a first base 8. The first base 8 allows the primary adapter 48 to connect to the manual cosmetic body 1. The removable brush 49 retains makeup and preferably applies makeup in a rotary motion, similar to that of the plurality of retractable brushes 9. The removable brush 49 comprises a second base 50 and a third applicator 51. The second base 50 connects the third applicator 51 to the secondary adapter 47. The third applicator 51 retains makeup, similar to the applicator 14 of the plurality of retractable brushes 9. The removable brush 49 is terminally connected to the motor housing 42. The motor housing 42 is mounted to the first base 8 of the manual cosmetic body 1 by the primary adapter 48, opposite the removable brush 49. This arrangement allows motor housing 42 to be connected to the manual cosmetic body 1 while allowing the removable brush 49 to accessed by the user. Similarly, the first base 8 is terminally fixed to the barrel 2, positioned opposite the opening 3 of the barrel 2, in order for the user to be able to access the plurality of retractable brushes 9 while the motor housing 42 is connected to the manual cosmetic body 1. Moreover, the primary adapter 48 is removably attached to the first base 8, opposite the barrel 2. The primary adapter 48 attaches the manual cosmetic body 1 to the motor housing 42 as a closed end 44 of the tubular handle 43 is removably attached to the primary adapter 48, opposite the first base 8. The secondary adapter 47 is attached to an open end 45 of the tubular handle 43, and the second base 50 is removably attached to the tubular handle 43 with the secondary adapter 47. The third applicator 5 is connected to the second base 50, positioned opposite the tubular handle 43, thereby positioning the third applicator 51 external to the tubular handle 43 and allowing the third applicator 51 to be easily accessible by the user.

Figure 11:
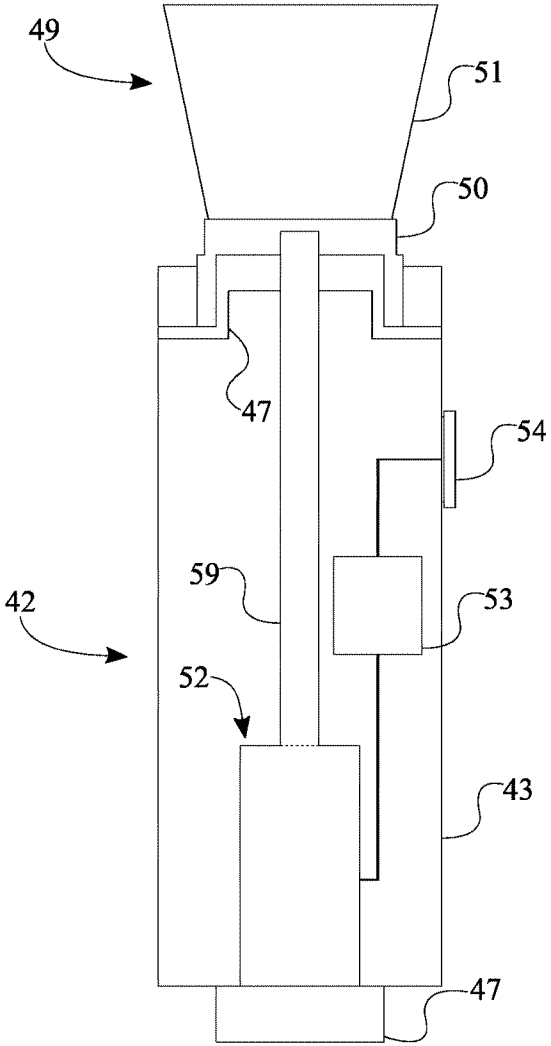
FIG. 11 is a schematic view of the electronic components of the first alternate embodiment of the present invention.

In order to automatically and continuously rotate the removable brush 49, the first alternate embodiment further comprises a motor 52, a power source 53, and a power switch, as shown in FIG. 11. The motor 52 rotates the removable brush 49 with the power from the power source 53. The power source 53 is preferably a portable power source 53 such as a battery. However, the power source 53 may comprise a power cord, a plug, and an external power supply, which allows the motor 52 to be recharged. The power switch 54 connects and disconnects the power source 53 from the motor 52 in order to turn the motor 52 on and off. The motor 52 is mounted within the tubular handle 43 in order to preserve the arrangement and engagement of the removable brush 49 with that of the tubular handle 43. The second base 50 of the removable brush 49 is rotatably connected to the motor 52 with an output shaft 59 of the motor 52, allowing the removable brush 49 to be both rotated and removably attached to the motor housing 42. The power switch 54 is laterally mounted to the tubular handle 43 in order for the user to turn off and turn on the motor 52. Moreover, the power source 53 is electrically connected to the motor 52 through the power switch.

The first embodiment further comprises a second cover 55. Similar to the first cover 28 and the manual cosmetic body 1, the second cover 55 encloses and protects the removable brush 49. A rim 56 of the second cover 55 is removably attached to a rim 46 of the tubular handle 43. The second cover 55 preferably snaps onto the tubular handle 43 as does the first cover 28 with the manual cosmetic body 1.

Although the invention has been explained in relation to its preferred embodiment, it is to be understood that many other possible modifications and variations can be made without departing from the spirit and scope of the invention as hereinafter claimed.

What is claimed is:

1. A multi-tip makeup brush tool comprising:

a main body;

a plurality of retractable brushes;

a removable casing;

a central brush;

a plurality of first spring-loaded mechanisms;

a second spring-loaded mechanism;

a third spring-loaded mechanism;

the main body comprising a barrel, a divider plate, a plurality of brush slots, a casing slot and a central slot;

the divider plate being mounted within the barrel;

the plurality of brush slots axially traversing through the divider plate;

the casing slot axially traversing through the divider plate;

the central slot axially traversing through the divider plate along a central axis of the divider plate;

the plurality of brush slots and the casing slot being radially distributed around the central slot;

the plurality of brush slots, the casing slot and the central slot being oriented parallel to a barrel opening of the barrel;

the barrel opening being delineated by a barrel rim of the barrel;

the plurality of retractable brushes being slidably engaged with the plurality of brush slots;

the removable casing being slidably engaged with the casing slot;

the central brush being slidably engaged with the central slot;

each of the plurality of retractable brushes comprising a brush handle and a brush applicator;

each of the brush handles traversing through a corresponding brush slot of the plurality of brush slots;

each of the brush applicators being terminally connected to a distal end of each of the brush handles oriented towards the barrel opening;

the removable casing comprising a cylindrical compartment and a bed;

the bed traversing through the casing slot;

the cylindrical compartment being removably mounted within the bed;

the central brush comprising a central handle and a central applicator;

the central handle traversing through the central slot;

the central applicator being terminally connected to a distal end of the central handle oriented towards the barrel opening;

the central applicator being larger than the each of the plurality of brush applicators;

the plurality of retractable brushes being operatively coupled with the barrel through the plurality of first spring-loaded mechanisms;

the removable casing being operatively coupled with the barrel through the second spring-loaded mechanism;

the central brush being operatively coupled with the barrel through the third spring-loaded mechanism;

the plurality of first spring-loaded mechanisms selectively extending and retracting the plurality of retractable brushes through the barrel opening;

the second spring-loaded mechanism selectively extending and retracting the removable casing through the barrel opening; and the third spring-loaded mechanism selectively extending and retracting the central brush through the barrel opening.

2. The multi-tip makeup brush tool as claimed in claim 1 comprising:

each of the plurality of first spring-loaded mechanisms comprising a first track, a first tab, a first spring, and a first notch;

each of the first tabs being laterally fixed along one of the brush handles;

each of the first tracks laterally traversing through and along the barrel;

each of the first tabs traversing through one of the first tracks;

each of the first springs being coaxially aligned with the one brush handle, and each of the first springs being positioned in between a respective tab of the first tabs and the divider plate;

a proximal end of each of the first springs being fixed to the respective first tab;

a distal end of each of the first springs being fixed to the divider plate; and each of the first notches laterally traversing through and along the barrel, positioned adjacent a respective track of the first tracks.

3. The multi-tip makeup brush tool as claimed in claim 2 comprising:

each of the brush handles comprising a first member and a second member;

each of the first members being attached to a respective one of the second members;

each of the first members and its respective second member being concentrically positioned with each other;

each of the first tabs being laterally fixed along its respective second member;

each of the second members traversing through the corresponding brush slot of the plurality of brush slots; and each of the brush applicators being terminally connected to a respective first member of the first members, and each of the brush applicators is towards the barrel opening.

4. The multi-tip makeup brush tool as claimed in claim 1 comprising:

the bed being positioned adjacent the cylindrical compartment, opposite a compartment opening of the cylindrical compartment;

the compartment opening being delineated by a compartment rim of the cylindrical compartment; and the compartment rim being oriented towards the barrel opening.

5. The multi-tip makeup brush tool as claimed in claim 1 comprising:

a brush cover; and a cover rim of the brush cover being attached to the barrel rim.

6. The multi-tip makeup brush tool as claimed in claim 2 comprising:

the second spring-loaded mechanism comprising a second track, a second tab, a second spring and a second notch;

the second tab being laterally fixed along the bed;

the second track laterally traversing through and along the barrel;

the second tab traversing through the second track;

the second spring being coaxially aligned with the bed, positioned in between the second tab and the divider plate;

a proximal end of the second spring being fixed to the second tab;

a distal end of the second spring being fixed to the divider plate; and the second notch laterally traversing through and along the barrel, positioned adjacent the second track.

7. The multi-tip makeup brush tool as claimed in claim 1 comprising:

the casing slot being positioned in between two adjacent brush slots of the plurality of brush slots; and the removable casing being positioned in between two adjacent brushes of the plurality of retractable brushes.

8. The multi-tip makeup brush tool as claimed in claim 4 comprising:

a cap;

at least one dual-ended brush;

the at least one dual-ended brush being positioned within the cylindrical compartment; and a cap rim of the cap being removably attached to the compartment rim over the at least one dual-ended brush.

9. The multi-tip makeup brush tool as claimed in claim 1 comprising:

the plurality of first spring-loaded mechanisms and the second spring-loaded mechanism being radially distributed about the central axis of the divider plate;

the casing slot and the plurality of brush slots being radially distributed about the central axis of the divider plate;

the casing slot being positioned adjacent to the second spring-loaded mechanism; and each brush slot being positioned adjacent to a corresponding first spring-loaded mechanism from the plurality of first spring-loaded mechanisms.

10. The multi-tip makeup brush tool as claimed in claim 6 comprising:

the third spring-loaded mechanism comprising a third track, a third tab, a third spring, and a third notch;

the third tab being laterally fixed along the central handle;

the third track laterally traversing through and along the barrel;

the third tab traversing through the third track;

the third spring being coaxially aligned with the central handle, positioned in between the third tab and the divider plate;

a proximal end of the third spring being fixed to the third tab;

a distal end of the third spring being fixed to the divider plate; and the third notch laterally traversing through and along the barrel, positioned adjacent the third track.

11. The multi-tip makeup brush tool as claimed in claim 1 comprising:

a motor housing;

a primary adapter;

a secondary adapter;

a removable brush head;

the main body comprising a first base;

the motor housing comprising a tubular handle;

the removable brush head comprising a bristle base and a bristle applicator;

the first base being terminally fixed to the barrel, positioned opposite the barrel opening;

a closed end of the tubular handle being removably attached to the first base by the primary adapter;

an open end of the tubular handle being removably attached to the bristle base by the secondary adapter; and the bristle applicator being connected to the bristle base, positioned opposite the tubular handle.

12. The multi-tip makeup brush tool as claimed in claim 11 comprising:

a motor;

a power source;

a power switch;

the motor being mounted within the tubular handle;

the bristle base being rotatably connected to an output shaft of the motor;

the power switch being laterally mounted to the tubular handle; and the power source being electrically connected to the motor through the power switch.

13. The multi-tip makeup brush tool as claimed in claim 11 comprising:

a bristle cover; and a bristle rim of the bristle cover being removably attached to a housing rim of the tubular handle.

* * * * *